United States Patent [19]

Lenders

[11] Patent Number: 4,494,097

[45] Date of Patent: Jan. 15, 1985

[54] ELECTROMAGNETIC DEFLECTION UNIT

[75] Inventor: Wilhelmus L. L. Lenders, Son, Netherlands

[73] Assignee: U.S. Philips Corporation, New York, N.Y.

[21] Appl. No.: 575,956

[22] Filed: Feb. 1, 1984

[30] Foreign Application Priority Data

Feb. 14, 1983 [NL] Netherlands ..... 8300543

[51] Int. Cl.[3] ..... H01F 5/02

[52] U.S. Cl. ..... 335/213; 335/210

[58] Field of Search ..... 335/210, 213; 313/421, 313/426, 428

[56] References Cited

U.S. PATENT DOCUMENTS

| | | | |
|---|---|---|---|
| 3,111,609 | 11/1963 | Webb | 335/213 |
| 3,875,543 | 4/1975 | Gostyn et al. | 335/210 |
| 3,878,490 | 4/1975 | Logan | 335/210 |

*Primary Examiner*—George Harris

*Attorney, Agent, or Firm*—Thomas A. Briody; William J. Streeter

[57] ABSTRACT

An electromagnetic deflection unit for a television display tube has two deflection coils disposed coaxially one within the other and each comprising two diametrically opposed coil units. Each deflection coil is wound against a surface of an associated hollow moulding, which in the case of the inner coil may be the envelope of the display tube. The respective surface of each moulding has a compound curvature which is concave in one direction and convex in a direction transverse thereto. Each coil unit of each deflection coil comprises a number of turns of wire which are laid around each other in a single layer or a plurality of superimposed layers on the respective surface of the respective moulding, the wire turns being held in position by contact adhesive applied to the wire and to the surface of the moulding.

15 Claims, 7 Drawing Figures

ELECTROMAGNETIC DEFLECTION UNIT

BACKGROUND OF THE INVENTION

1. Field of the Invention

The invention relates to an electromagnetic deflection unit and more particularly to an electromagnetic deflection unit for deflecting the electron beam or beams in a display tube which is used for displaying pictures in a television receiver.

2. Description of the Prior Art

With the advent of display tubes of large maximum deflection angle in the field of television, it has become more and more difficult to design and manufacture electromagnetic deflection units which deflect the electron beam or beams of said tubes in the correct manner to provide a commercially acceptable television frame on the associated screen. An electromagnetic deflection unit normally comprises two pairs of deflection coil units. One pair of coil units is used to provide vertical deflection of the electron beam(s), while the other pair is used for providing horizontal deflection of the beam(s). Display tubes which require a beam deflection over a large angle, more particularly color television tubes, require the generation of magnetic fields having an accurately defined configuration, or field distribution, both by the horizontal and by the vertical deflection coil units in order to correctly deflect the electron beam or beams in the tube.

The coil units for the horizontal or line deflection are generally constructed so as to fit around the neck and funnel portions of the cathode-ray tube and have saddle-type windings. The individual coil units are automatically wound on a winding machine. The coil units for the vertical deflection may also be of the saddle type or they may be of the torroidal type. In the latter case they are wound torroidally in the axial direction around the soft-magnetic yoke ring of the deflection unit.

Coil units of the saddle type are usually wound in a two-part mould (see U.S. Pat. No. 3,086,562). The outer circumference of the aperture in which the wire is to be guided is not situated in one plane but follows an intricate path.

Wing-shaped parts are connected to the two mould halves so as to slide the wire in the aperture. The winding wire has a thermoplastic layer of bonding material so that, after winding, a self-supporting coil can be obtained by means of heat and pressure.

It is furthermore known from laid-open Japanese Patent Application No. 57-23451 to wind a coil on a coil former in which the wire is guided by the winding machine and is fixed at discrete points by supplying an adhesive.

In order to achieve a reasonable reproducibility of the saddle coils, the utmost care should be paid to, inter alia, the shape of the moulds, the constancy of the outside wire diameter, the thickness of the layer of a thermoplastic bonding material, the smoothness of the wire, the softening temperature of the bonding layer, the wire tension during winding, the temperature of the mould during winding, and the winding speed.

Tolerances in the above-mentioned parameters, and also the process of arbitrary winding and the uncontrolled sliding of the wire from the wings of the mould during winding, have so far militated against a good reproducibility. This applies particularly in the case of coils the length of which is of the size of their winding height and the active parts (the flanks) of which are curved. A good reproducibility is achieved if in all coils of a series of deflection units each turn having the same sequence number is located in exactly the same position.

SUMMARY OF THE INVENTION

It is an object of the invention to provide a deflection unit in which tolerances in one or more of the said parameters no longer play a part in the reproducibility attainable. According to the invention there is provided an electromagnetic deflection unit for a television display tube, comprising a first deflection coil of the saddle type and a second deflection coil disposed coaxially with respect to the first, each coil comprising two diametrically opposed coil units, wherein the first deflection coil is wound against a surface of a first hollow moulding, which surface has a compound curvature such that it is concave in a first direction and convex in a direction transverse to the first direction, and which surface is provided with a layer of contact adhesive, each coil unit of the first deflection coil comprising a number of turns of wire which are laid around each other in a single layer or a plurality of superimposed layers on said surface of the first moulding, the wire having a coating of contact adhesive and the turns of said single layer being fixed throughout their length to the layer of contact adhesive on said surface, or the turns of the layer which is adjacent said surface being fixed throughout their length to the layer of contact adhesive on said surface and the turns of the or each further layer being fixed to the turns of the preceding layer.

Laying each point of each turn in its require location can be achieved with the aid of a moulding which is constructed as one half of a mould of the type which is used in the conventional winding process. As a result of this it is possible to supply the wire parallel to the winding axis and to press it in the correct location by means of a wire guide. This latter can be effected by moving the wire guide with respect to the coil support according to a programme determined for each turn individually. It is then important that the fixing of the wire by means of the contact adhesive in the location where the wire has been laid on the surface of the moulding should be carried out instantaneously or substantially instantaneously so that a reasonable winding speed can be achieved.

The envelope of the display tube itself may serve as the first moulding, or a separate moulding, for example of a synthetic-resin material, may be used, in which case the moulding (with optional reference holes or studs) and the coil units thereon and mounted as one assembly in the correct location on the display tube.

Winding the coil units against a surface which has a compound curvature such that it is concave in one direction and convex in a direction transverse thereto, the surface being either a surface of a synthetic resin moulding which accurately fits around the display tube or a surface of the envelope of the display tube itself, and each turn being laid and fixed in position according to a computer programme, presents the following advantages:

1. A substantial reproducibility is ensured.

2. If a separate synthetic-resin moulding is used the coil and the moulding form one assembly and as such can be easily and accurately assembled.

3. As a result of the guided laying of the wires the latter may be connected to connection pins on the moulding itself.

4. No application of heat is required on the moulding and hence the current difficulty of controlling heat dissipation in a winding mould is avoided.

5. Changes in the coil by a design department can be tried rapidly without it being necessary to manufacture or alter moulds for the modified coil, but simply by changing the computer programme.

6. Coil changes no longer require the manufacturing department to manufacture and trim new moulds but simply to give the programmed tape for winding the new coil, already provided by the designing department, to the production department which can continue the production of the new coil substantially without delay.

The coil for deflecting the electron beam(s) in the horizontal direction, the line coil, is the deflection coil which in the first instance is suitable to be attached to a surface of a moulding (turn-by-turn) by means of an adhesive. The deflection coil for deflecting the electron beam(s) in a vertical direction, the field coil, may be constructed in a number of different ways.

The field coil may be wound torroidally on an annular core of soft-magnetic material which is disposed coaxially around the moulding carrying the line coil.

The field coil, as well as the line coil, may alternatively be of the saddle-type and be wound against the surface of a hollow moulding. If the line coil comprises only a small number of layers of turns, this moulding may be the moulding carrying the line coil, in which case the coil units of the field coil are wound over the line coil but are displaced by 90° about the axis of the coils with respect to the coil units of the line coil. Alternatively, the coil units of the field coil may be formed on a second moulding which is subsequently placed coaxially around the moulding carrying the line coil.

In one embodiment of the deflection unit according to the invention, a layer of synthetic resin having a smooth surface is provided over the first deflection coil and over such part of said surface of the first moulding as is not occupied by the first deflection coil, a layer of contact adhesive is provided on the layer of synthetic resin, and the second deflection coil also is of the saddle-type and each coil unit of the second deflection coil comprises a number of turns of wire which are laid around each other in a plurality of superimposed layers on the layer of synthetic resin, the wire having a coating of contact adhesive and the turns of the layer which is adjacent the layer of synthetic resin being fixed throughout their length to the layer of contact adhesive on the layer of synthetic resin and the turns of the or each further layer being fixed to the turns of the preceding layer.

It is advantageous if the synthetic resin comprises a filler such that the coefficient of thermal conductivity of the synthetic resin is adapted to that of the copper of the wires of the coil units. The thermal energy produced in the coils upon energisation can then be readily dissipated to the atmosphere. The synthetic resin may either be interposed between the first and second coils, if these are both carried on the same moulding, or it may fill the spaced between the first and second mouldings if the first and second coils are each supported on an individual moulding.

Each coil unit of the first deflection coil or of each of the first and second deflection coils may comprise a plurality of superimposed layers of wire turns arranged so that each turn of each layer, excepting the layer adjacent the surface on which the respective coil unit is supported, bears against two adjacent turns of the subjacent layer.

Because the wires of the coils can be laid on the respective supporting surfaces without stress and at the desired locations, the thickness of the walls of synthetic-resin mouldings for providing the supporting surfaces may be very small, for example 1 mm. This contrasts with the conventional deflection units which require coil supports having comparatively thick walls in order to be able to withstand the forces occurring upon assembly of the prewound, refractory coils which have to be pressed into the desired shape.

By forming coils with wires which are laid in turns in a guided manner and are fixed as they are laid, it is possible to obtain coils with saddle-type coil units in which the turns of each coil unit define a window having two sides which extend substantially in the direction of the longitudinal axis of the coil and which are connected at their ends by sides which extend in transverse directions with respect to said axis, the two longitudinally extending sides curving inwardly towards each other. Coils having inwardly curving longitudinal sides cannot be obtained by conventional winding methods.

In another embodiment of the deflection unit according to the invention, the turns of each of the coil units of the first deflection coil constitute first and second windings having the same winding senses which leave between them an area free which is bounded by oppositely located winding segments having mutually opposite winding senses. The importance of this will be described in detail hereinafter.

Embodiments of the invention will now be described in greater detail, by way of example, with reference to the accompanying drawings.

DESCRIPTION OF THE PREFERRED EMBODIMENT

Figure 1:
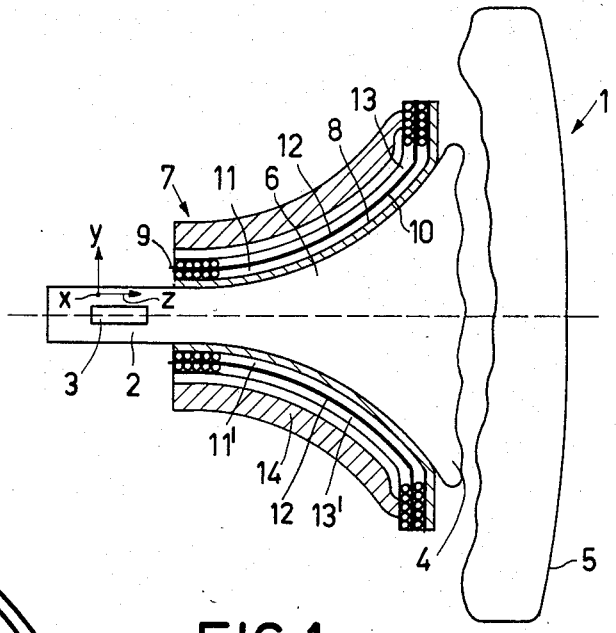
FIG. 1 is a diagrammatic axial sectional view of an electromagnetic deflection unit according to an embodiment of the invention mounted on a cathode-ray tube.
Figure 2B:
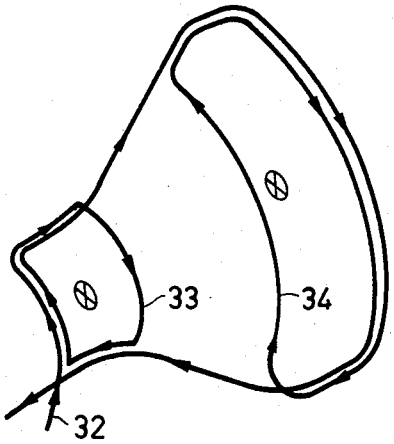
FIG. 2*b* shows diagrammatically a winding pattern of a coil unit for a deflection unit according to the invention.
Figure 2A:
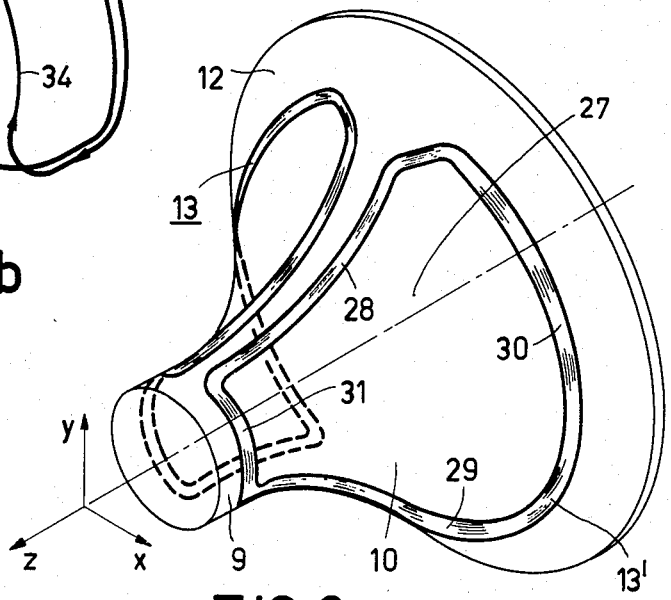
FIG. 2*a* is a perspective view of a hollow moulding having two coil units wound directly against its outer surface.

FIG. 1 is a sectional view taken on the y-z plane of a display tube 1 having an envelope 6 which widens from a narrow neck portion 2 in which a gun system 3 is mounted to a wide portion 4 which comprises a display screen 5. A deflection unit 1 is mounted on and surrounds the part of the envelope 6 which extends between the portions 2 and 4. The deflection unit 7 comprises a hollow moulding 8 of a synthetic-resin material, on the outer surface of which is supported a first deflection coil comprising a pair of diametrically opposed coil units 11, 11' for generating a (line) deflection field for deflecting an electron beam or electron beams produced by the gun system 3 in a horizontal direction. Disposed around the first deflection coil coaxially therewith is a second deflection coil comprising a pair of diametrically opposed coil units 13, 13' for generating a (field) deflection field for deflecting an electron beam or beams produced by the gun system 3 in the vertical direction. The coil units 13, 13' are supported by a second hollow synthetic-resin moulding 12 which coaxially surrounds the first moulding 8. The pairs of coil units 11, 11' and 13, 13' are displaced 90° about the axis of the coils with respect to one another and are surrounded by an annular coil 14 of a soft-magnetic material. The individual coil units of the pairs of coil units 11, 11' and 13, 13' are of the so-called saddle-type. They are wound and fixed directly on their respective mouldings in a manner such as to generate deflection fields which satisfy the requirements imposed. In a given case the coil units 11, 11' of the pair of coil units for the line deflection could each consist of a small number (for example five) of juxtaposed turns laid around each other in one layer on the surface of the respective moulding. Such a small number of turns could alternatively be supported on the inner surface of the moulding 12 or even directly on the tube envelope 6, instead of on the moulding 8. With such a small number of turns in each coil unit of the first deflection coil, a substrate for supporting the coil units 13, 13' of the second deflection coil could be formed by providing a thin layer of synthetic resin having a smooth surface over the first deflection coil and over such part of the outer surface of the moulding 8 as is not occupied by the first deflection coil. In that case the moulding 12 may be omitted.

FIG. *2a* is a perspective view of the hollow synthetic-resin moulding 12 of the deflection unit 7 of FIG. 1. The wire turns of the coil units 13, 13' are wound and fixed directly against the outer surface of the moulding 12. For this purpose the outer surface of the moulding 12 is provided with a layer of contact adhesive and the wires themselves are also coated with a layer of contact adhesive. The moulding 12 has a cylinder rear portion 9 and a gradually widening front portion 10.

Figure 3:
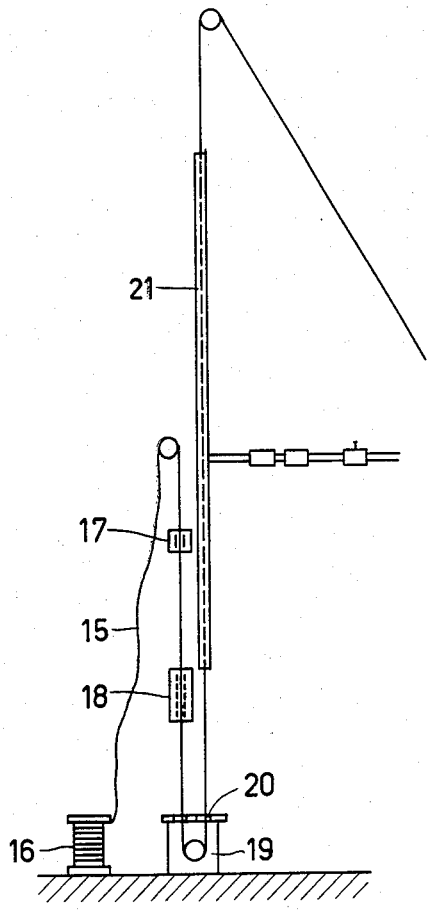
FIG. 3 is a diagrammatic elevation of a device with which a wire for a coil unit can be coated with a layer of adhesive.

FIG. 3 shows a device with which a wire 15 can be coated with a layer of contact adhesive. The wire 15 is supplied from a reel 16. In order to remove contaminants for example paraffin, the wire 15 is pulled between two pieces of felt 17 which are soaked with dry-cleaning naphtha. The clean wire 15 is then passed through a wire-tautening device 18 and subsequently through a bath of adhesive 19 in which a concentric layer of adhesive is provided around the wire 15, excess adhesive being removed from the wire by means of a calibrated aperture 20. The wire 15 is finally passed through a drying station 21, for example, a pipe through which hot air is blown.

Figure 4:
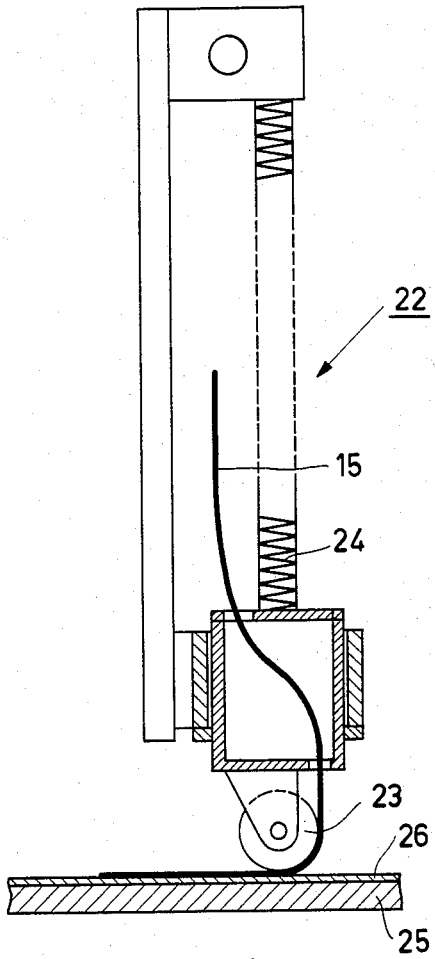
FIG. 4 is a side elevation, partly in section, of a guiding device with which a wire can be laid in turns on a supporting surface in a controlled manner.

To lay the wire 15 in turns on a surface which has a compound curvature such that it is concave in a first direction and convex in a direction transverse to the first direction, for example, the outer surface of the moulding 12, a guiding device or winding finger 22 (FIG. 4) may be used. An important component of the device 22 is a castor 23 comprising a peripherally grooved wheel, around which the wire 15 is guided. A spring 24 ensures that the wire 15 is urged against the substrate 25 at a constant force (of, for example 500 grf). The device 22 can be controlled so that when laying the wire 15 in turns on the substrate (which can take place at a low voltage) the swivel axis of the castor 23 is always at right angles to the substrate 25. A layer of contact adhesive 26 is provided on the substrate 25 to a thickness of, for example, 0.015 mm. This layer is dried prior to laying the wire 15 which itself is coated with a layer of contact adhesive to a thickness of, for example, 0.01 mm.

Figure 5:
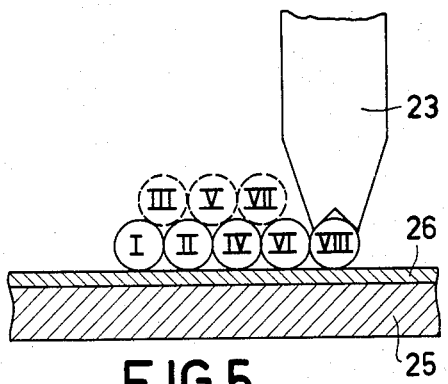
FIG. 5 shows a detail of a device shown in FIG. 4.

FIG. 5 shows a number of turns of the wire 15 laid beside each other in two superimposed layers by means of the castor 23.

Referring back to FIG. *2a*, it is to be noted that the winding pattern of the wire of the coil unit 13' as well as that of the wire the coil unit 13 is such that in each coil unit a window 27 is defined by two portions 28, 29 of the coil unit which extend substantially in the direction of the longitudinal axis of the respective deflection coil, and by portions 30, 31, which extend between the ends of the portions 28, 29 in transverse directions with respect to the longitudinal axis of the coil, the longitudinally extending portions 28, 29 curving inwardly towards each other. The result of this design is that the field deflection coil units 13, 13', upon energisation, generate a deflection field which in the area of the inwardly curving portions of the coil units 13, 13' has an intensified barrel-shaped distribution. The nominal value of the six-pole field responsible for the barrel-shaped distribution in deflection coils according to the invention can be adjusted so that a larger variation is permissible than in conventional deflection coils. The manufacture of deflection units according to the invention can hence be associated with a smaller reject percentage.

FIG. *2b* shows a winding pattern of a wire 32 which provides an alternative to the winding pattern of the wire in FIG. *2a*.

In this case also a barrel-shaped distribution of the (field) deflection field in the central area is achieved by laying the wire 32 in a manner such that in the central area turns 33 and 34 of opposite winding senses are facing each other.

Figure 6:
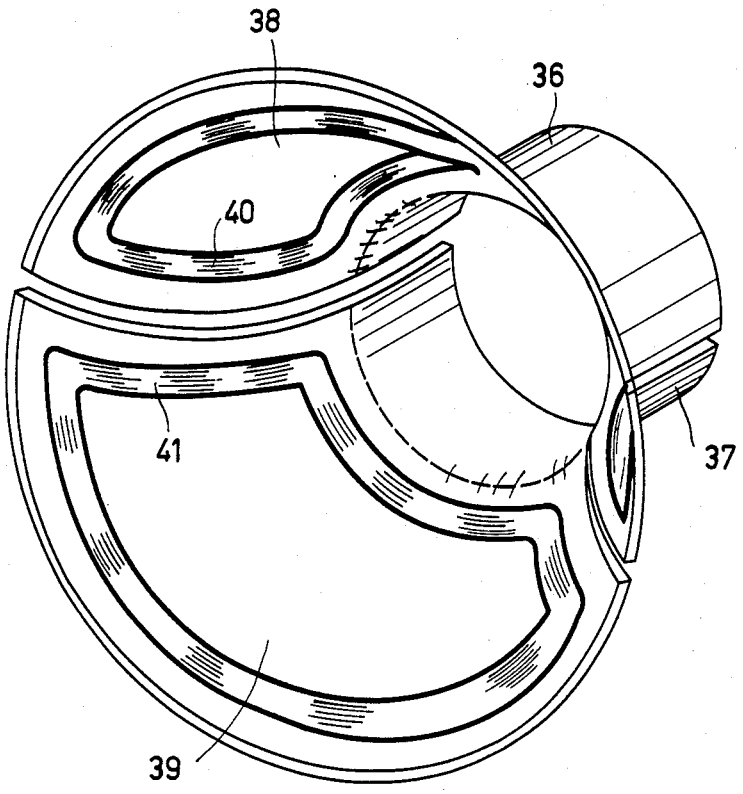
FIG. 6 is a perspective view of two hollow half-mouldings having coil units wound against their inner surfaces.

Within the scope of the invention, the turns of the coil units may also be wound against the inner surface of a hollow moulding. In that case, preferably two hollow half-mouldings 36 and 37 (FIG. 6) are used having inner surfaces 38 and 39, respectively, against each of which a coil unit 40, 41, respectively, is directly wound and is fixed by means of contact adhesive.

What is claimed is:

1. An electromagnetic deflection unit for a television display tube comprising a first deflection coil of the saddle type and a second deflection coil disposed coaxially with respect to the first, each coil comprising two diametrically opposed coil units, wherein the first deflection coil is wound against a surface of a first hollow moulding, which surface has a compound curvature such that it is concave in a first direction and convex in a direction transverse to the first direction, and which surface is provided with a layer of contact adhesive, each coil unit of the first deflection coil comprising a number of turns of wire which are laid around each other in a single layer or a plurality of superimposed layers on said surface of the first moulding, the wire having a coating of contact adhesive and the turns of said single layer being fixed throughout their length to the layer of contact adhesive on said surface, or the turns of the layer which is adjacent said surface being fixed throughout their length to the layer of contact adhesive on said surface and the turns of each further layer being fixed to the turns of the preceding layer.

2. A deflection unit as claimed in claim 1 wherein the first deflection coil is wound against the outer surface of the first moulding.

3. The deflection unit as claimed in claim 1 wherein the first moulding consists of two halves and the two coil units of the first deflection coil are wound one against the inner surface of each half of the first moulding.

4. A deflection unit as claimed in claim 1 wherein a layer of synthetic resin having a smooth surface is provided over the first deflection coil and over such part of said surface of the first moulding as is not occupied by the first deflection coil, wherein a layer of contact adhesive is provided on the layer of synthetic resin, and wherein the second deflection coil also is of the saddle-type and each coil unit of the second deflection coil comprises a number of turns of wire which are laid around each other in a plurality of superimposed layers on the layer of synthetic resin, the wire having a coating of contact adhesive and the turns of the layer which is adjacent the layer of synthetic resin being fixed throughout their length to the layer of contact adhesive on the layer of synthetic resin and the turns of each further layer being fixed to the turns of the preceding layer.

5. A deflection unit as claimed in claim 1 wherein the second deflection coil is also of the saddle-type and is wound over the first deflection coil on the first moulding, the coil units of the second deflection coil being displaced by 90° about the axis of the coils with respect to the coil units of the first deflection coil.

6. A deflection unit as claimed in claim 1 wherein the second deflection coil is also of the saddle-type and is wound against a surface of a second hollow moulding coaxially surrounding the first moulding, which surface has a curvature such that it is concave in a first direction and convex in a direction transverse to the first direction, and which surface is provided with a layer of contact adhesive, each coil unit of the second deflection coil comprising a number of turns of wire which are laid around each other in a single layer or a plurality of superimposed layers on said surface of the second moulding, the wire having a coating of contact adhesive and the turns of said single layer being fixed throughout their length to the layer of contact adhesive on said surface of the second moulding, or the turns of the layer which is adjacent said surface of the second moulding being fixed throughout their length to the layer of adhesive on said surface of the second moulding and the turns of each further layer being fixed to the turns of the preceding layer.

7. A deflection unit as claimed in claim 6 wherein the space between the first and second mouldings is filled by a layer of synthetic resin.

8. A deflection unit as claimed in claim 1 wherein each coil unit of the first deflection coil or of each of the first and second deflection coils comprises a plurality of superimposed layers of wire turns arranged so that each turn of each layer, excepting the layer adjacent the surface on which the respective coil unit is supported, bears against two adjacent turns of the subjacent layer.

9. A deflection unit as claimed in claim 1 wherein the length of the first deflection coil is of the size of its winding height.

10. A deflection unit as claimed in claim 4 wherein the length of the first deflection coil and the length of the second deflection coil are short compared with the winding height.

11. A deflection unit as claimed in claim 1, wherein the first moulding is the envelope of a display tube.

12. A deflection unit as claimed in claim 1 wherein the first moulding is made of a synthetic resin material.

13. A deflection unit as claimed in claim 6 wherein the second moulding is made of a synthetic-resin material.

14. A deflection unit as claimed in any claim 1 wherein the turns of each of the coil units of the first deflection coil define a window having two sides which extend substantially in the direction of the longitudinal axis of the coil and which at their ends are connected by sides which extend in transverse directions with respect to said axis, the two longitudinally extending sides curving inwardly towards each other.

15. A deflection unit as claimed in claim 1 wherein the turns of each of the coil units of the first deflection coil constitute a first and a second winding having the same winding senses which leave between them an area which is bounded by oppositely located winding segments having mutually opposite winding senses.

* * * * *